US005931608A

United States Patent [19]

Wilkinson

[11] Patent Number: 5,931,608

[45] Date of Patent: Aug. 3, 1999

[54] TRENCH SHORING TRANSPORT DEVICE

[76] Inventor: Ivan R. Wilkinson, 5457 W. Black Canyon Rd., Emmett, Id. 83617

[21] Appl. No.: 08/914,037

[22] Filed: Aug. 8, 1997

[51] Int. Cl.[6] ..... E02D 17/04

[52] U.S. Cl. ..... 405/283; 405/273

[58] Field of Search ..... 405/272, 273, 405/282, 283

[56] References Cited

U.S. PATENT DOCUMENTS

| | | | |
|---|---|---|---|
| 3,404,533 | 10/1968 | Brunton | 405/282 |
| 3,782,125 | 1/1974 | Holl | 405/282 |
| 3,788,086 | 1/1974 | West, Jr. | 405/283 |
| 5,306,103 | 4/1994 | Spencer | 405/282 |

*Primary Examiner*—Tamara Graysay
*Assistant Examiner*—Tara L. Mayo
*Attorney, Agent, or Firm*—Joseph W. Holland

[57] ABSTRACT

An trench shoring transport device having a trench box depending from a frame, the frame including a pair of side frame subassemblies which are slideably and adjustably engaged to each other allowing the width of the frame and hence the width of the device's wheelbase to be widened or narrowed as required. The frame is supported by a number of wheel assemblies which allow the device to be rolled along the ground. A trench box or a series of trench boxes depend below the frame from a pair of hydraulic vertical support members. The device is configured to allow the trench box to be raised between the pair of side frame subassemblies and substantially above the elevation of the frame. In addition the trench shoring transport device may include a feature which allows a pair of trench boxes to be split during operations to allow for passage of an obstruction encountered during excavation to pass through the pair of trench boxes.

12 Claims, 10 Drawing Sheets

TRENCH SHORING TRANSPORT DEVICE

RELATED APPLICATIONS

This application is related to U.S. application Ser. No. 08/759,976 entitled Improved Movable Trench Shoring Device, filed Dec. 3, 1996.

BACKGROUND OF THE INVENTION

1. Technical Field

The present invention relates generally to devices for trench shoring and, more specifically, to a device that may be readily positioned and moved along a length of trench, for shoring the trench.

2. Background

Trench shoring is used to secure the sides of ditches and trenches which may be occupied by laborers during operations which may occur within the trench, oftentimes in utility construction and maintenance. Trench shoring typically consists of two opposing panels which are held in spaced apart relationship by a plurality of struts or spreaders which may be of a fixed and interchangeable length or in the alternative adjustable in length, thereby adjusting the distance between the spaced apart panels for any given width of ditch.

Once the trench is opened by excavation, the shoring or trench box is set into the trench. Laborers may then enter the trench and work at the bottom in a far safer environment than that which would exist in an open trench. As the trenching advances, additional trench boxes may be placed along the trench or, alternatively, a trench box may be advanced along the length of the trench as it advances with the work. In this case, the box is typically lifted by the hoe or shovel which is performing the excavation and advanced along the length of the trench and then dropped or placed into the trench.

A number of disadvantages are present with this arrangement, including the fact that the trench boxes typically set at the bottom of the ditch which reduces the clearance between the lower spreaders and the work which is being performed at the bottom of the trench. Additionally, moving the trench box or advancing the box along the trench is a cumbersome and time consuming operation.

A number of solutions have been suggested to address these and other disadvantages. West Jr., U.S. Pat. No. 3,788,086, discloses a trench barrier having a horizontal frame carriage with wheels mounted on the ends of the frame carriage. West discloses a carriage having suspended from it a pair of spaced apart shield members which may be held in spaced apart relation by jacks extending between the shield members. West also discloses vertically disposed cooperating telescoping struts which are carried by the carriage for adjusting the relative vertical position of the shield members, and allows for varying the height at which the shield members are suspended in the trench. However, the device disclosed by West is configured having wall members which extend well past the ends of the frame carriage and the axles, thereby restricting vertical movement of the wall members to a height determined by the elevation of the frame carriage and the axles.

Arnold, U.S. Pat. No. 4,874,271, discloses a trench shoring machine having a main frame having a pair of substantially vertical guide members carried by the main frame, a pair of transversely extending carrier bars engage the pair of vertical guide members, and opposed shoring plates supported from the carrier bars which are moveable along the length of the carrier bars. Arnold further discloses a pair of shoring plates, including a top plate and a lower plate, which are movable between relatively upper and lower positions with respect to the main frame, together with means for moving the lower plate between an upper and lower position.

The device disclosed by Arnold allows the shoring plates to be raised above the elevation of the axles, but accomplishes this through a configuration wherein the main frame is suspended through the use of a triangular carrier frame located at each wheel. This configuration results in placement of the substantial weight of the main frame well above the axles. This configuration results in a raised center of gravity for the apparatus. During operations, which typically occur along an open trench having excavation tailings piled along either side of the trench, the heightened center of gravity may cause a propensity in the apparatus to overturn.

In Spencer, U.S. Pat. No. 5,306,103, a carriage assembly is disclosed which supports a trench box in a suspended relationship having a pair of axles, a pair of spaced apart bracket elements disposed on each axle, a pair of wheel assemblies disposed at opposite ends of each axle and a support member attached to each of the bracket elements in a downwardly depending relation thereto, the support member being connected to the trench box.

In Spencer, a support member extends for a portion of its length through rigidifying members located near the outer edges of each of the two trench shields. The overall configuration of the apparatus disclosed by Spencer results in a fairly rigid structure which may be suitable for lightweight panels, fabricated of aluminum for instance, and panels of a limited height and depth. However such a rigid configuration is unsuitable for use with large steel panels used in many applications. Once again, vertical travel of the trench box is limited by the elevation of the frame and axles.

What is needed is an improved trench shoring transport device, for use with large steel trench shoring boxes, which is capable of supporting boxes which may reinforce and support trench banks as shallow as 4 feet and as deep as 25–30 with shoring panels as wide as 36 feet. What is also needed is a portable or moveable trench shoring transport device which provides a support means for the shoring box which allows for adjustment of the height of the shoring box or panels relative to the frame so that the top edge of the panel shoring box or panels may be adjusted above the elevation of the frame, thereby providing increased flexibility in the working dimensions of the device so that it may accommodate a variety of ditch depths without having to interchange larger panels for shorter panels.

Additionally, it would be advantageous to have a trench shoring transport device which allows for variation and adjustability of the wheel base width. Additionally, it would be advantageous to have a trench shoring transport device which provides a means for splitting an upper and a lower pair of trench boxes when an obstacle is encountered in excavation. Additional objects, advantages and novel features of the invention will be set forth as part of the description that follows and, in part, will become apparent to those skilled in the art upon examination of the following or may be learned by practice of the invention.

SUMMARY OF THE INVENTION

According to the invention, these and other objects are achieved by a trench shoring transport device which allows the device to be moved along a surface adjacent to the trench. The device includes a frame having a pair of side frame subassemblies slideably and adjustably attached to one another. The frame is supported by four wheel assemblies, one wheel assembly located near each of the four corners of the frame. The device's configuration allows the frame to be arranged having a range of possible widths and hence a range of possible wheel base widths.

A trench box, or a plurality of trench boxes each having a pair of opposing panels and a plurality of spreaders for maintaining the relative distance between the trench box panels are suspendable from the frame. The trench box is suspendable from a primary means for suspending the first trench box, which in one embodiment of the invention includes a pair of powered vertical support members which are located one at each end of the trench box. In the preferred embodiment of the invention, the powered vertical support members are hydraulically actuated. The vertical support members are attached to the frame and the trench box employing connectors which allow for a wide range of freedom of movement about the connection, thereby substantially reducing the risk of bending or breaking the various structural elements of the device.

The pair of hydraulically actuated vertical support members are sized and configured to lift and lower the trench box within the frame. Additionally, the disclosed configuration allows the trench box to be raised or lifted between the elements of the frame permitting a broad range of height configurations for the movable trench shoring device including height configurations wherein the top of the trench box is raised above the elevation of the frame.

In addition, the degree of freedom of movement between the various components of the frame, the hydraulically actuated vertical support members and the spreaders permit the device to adapt to a variety of trench configurations without binding within the trench during operations and while advancing the device in the trench, thereby substantially reducing the risk of damage to the device and its various component parts.

In addition, in those cases where the trench shoring transport device is configured having an upper and a lower pair of trench boxes, one embodiment of the present invention provides a means for splitting the upper and a lower pair of trench boxes when an obstacle is encountered in excavation allowing the obstruction to pass between the pair of trench boxes, thereby permitting work to progress in a substantially uninterrupted manner.

Additional objects, advantages and novel features of the invention will be set forth in part in the description that follows, and in part will become apparent to those skilled in the art upon examination of the following or may be learned by practice of the invention.

DETAILED DESCRIPTION OF THE INVENTION

Figure 1:
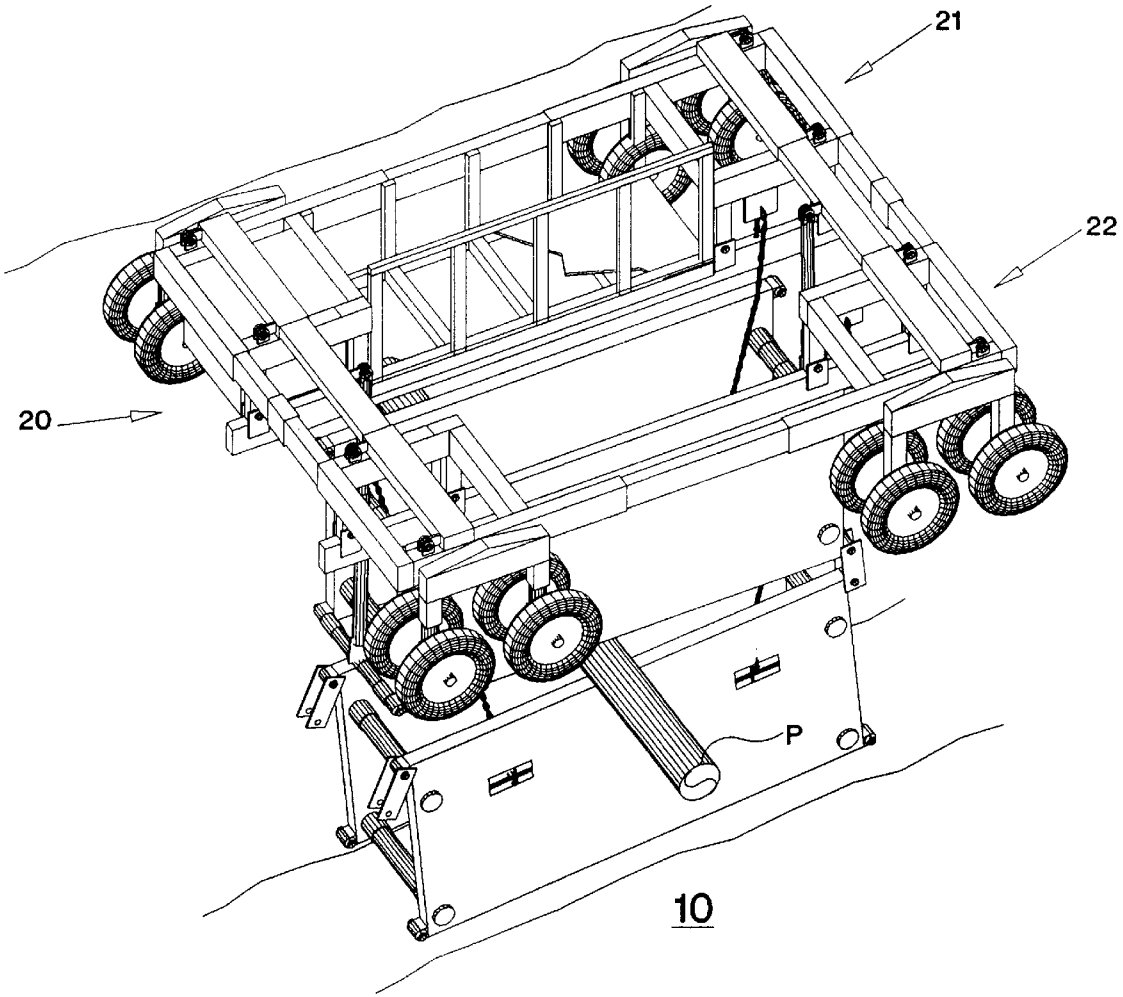
FIG. 1 is a perspective representational view of the trench shoring transport device.

Referring now to FIG. 1 the trench shoring transport device 10 will be more fully described and understood. FIG. 1 is a perspective representational view of trench shoring transport 10 showing various elements and components of the device, including frame 20. Frame 20 includes generally a first side frame sub-assembly 21 and second side frame sub-assembly 22. Each side frame sub-assembly in turn includes a number of components.

Figure 9:
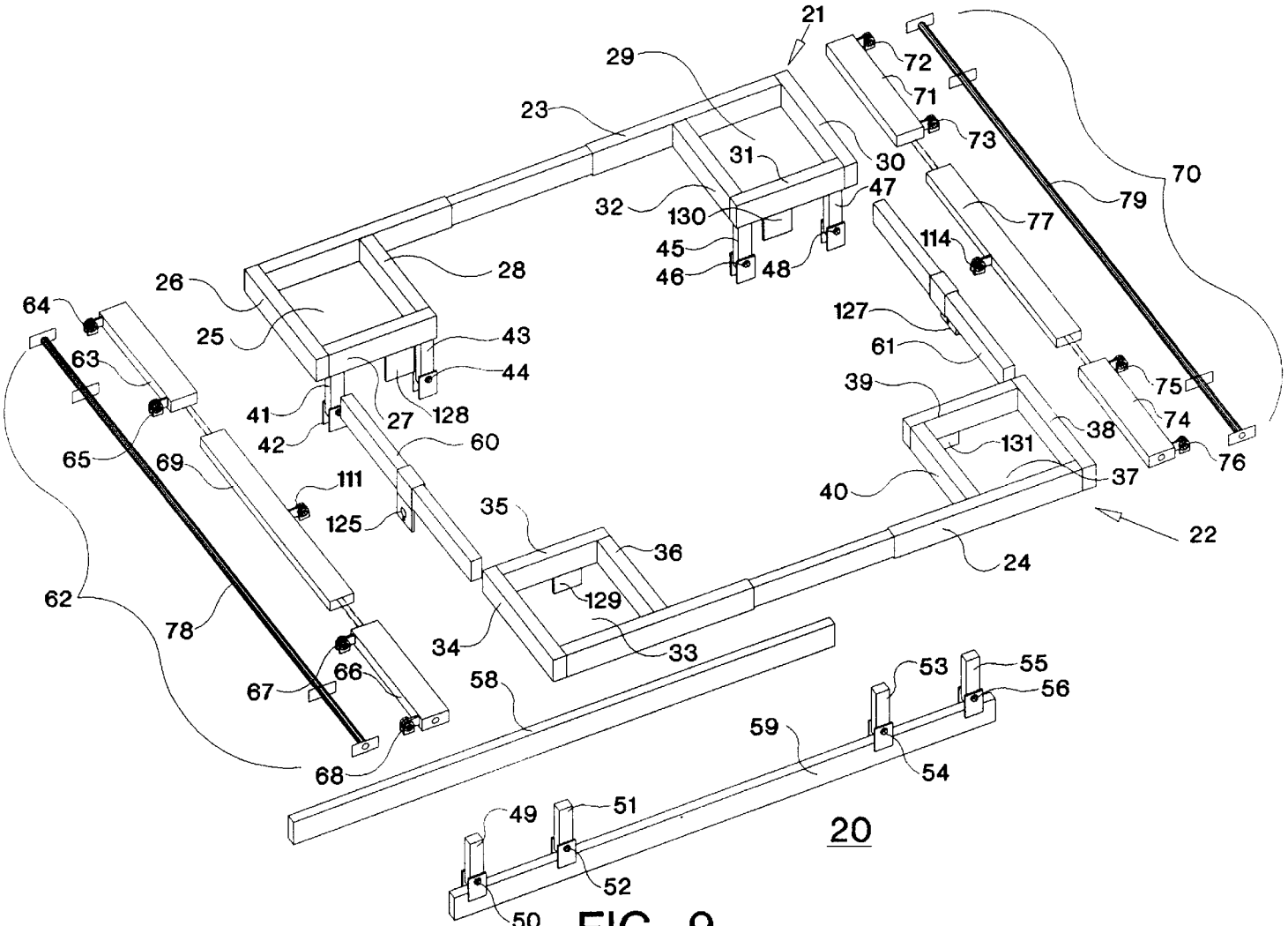
FIG. 9 is an exploded detail perspective representational view of the frame portion of the trench shoring transport device.

As shown in FIG. 9, first side frame sub-assembly 21 includes first side frame side member 23 which extends from the front to the rear of the apparatus. In the preferred embodiment of the invention, attached at either end are first side frame first end box member 25 and first side frame second end box member 29. First side frame first end box member 25 includes first side frame first end member 26, first side frame first end inboard frame member 27, and first side frame first end transverse member 28. Similarly, first side frame second end box member 29 includes first side frame second end member 30, first side frame second end inboard frame member 31, and first side frame second end transverse member 32.

Second side frame sub-assembly 22 is basically a mirror image of first side frame sub-assembly 21, and includes second side frame member 24 which extends from the front of the apparatus to the rear. Second side frame sub-assembly 22 also includes second side frame first end box member 33 and second side frame second end box member 37. Second side frame first end box member 33 includes second side frame first end member 34, second side frame first end inboard frame member 35, and second side frame first end transverse member 36. Similarly, second side frame second end box member 37 includes second side frame second end member 38, second side frame second end inboard frame member 39, and second side frame second end transverse member 40.

By design, the various frame box end members provide required structural rigidity for the apparatus and, in addition, second side frame second end box 37 is provides a protective bay for hydraulic power unit 200 which contains the various hydraulic components including the power plant, pump, and hydraulic reservoir described herein below.

Referring to FIG. 9, first side frame sub-assembly 21 and second side frame sub-assembly 22 are slideably and adjustably engaged one to the other by a pair of telescoping frame members. First frame end telescoping member 60 engages first side frame first end member 26 and second side frame first end member 34. Similarly, second frame end telescoping member 61 slideably engages first side frame second end member 30 and second side frame second end member 38.

Referring again to FIG. 9, each side frame sub-assembly also includes a number of side frame vertical members. First side frame sub-assembly 21 includes first side frame first vertical member 41 and first side frame second vertical member 43, both attached at their upper ends to first side frame first end inboard frame member 27. First side frame sub-assembly 21 also includes first side frame third vertical member 45 and first side frame fourth vertical member 47, each attached at their upper ends to first side frame send end inboard member 31.

Similarly, second side frame sub-assembly 22 includes second side frame first vertical member 49 and second side frame second vertical member 51, each attached at their upper ends to second side frame first end inboard frame member 35. Finally, second side frame sub-assembly 22 includes second side frame third vertical member 53 and second side frame fourth vertical member 56 attached at their upper ends and extending below second side frame second end inboard frame member 39.

Figure 2:
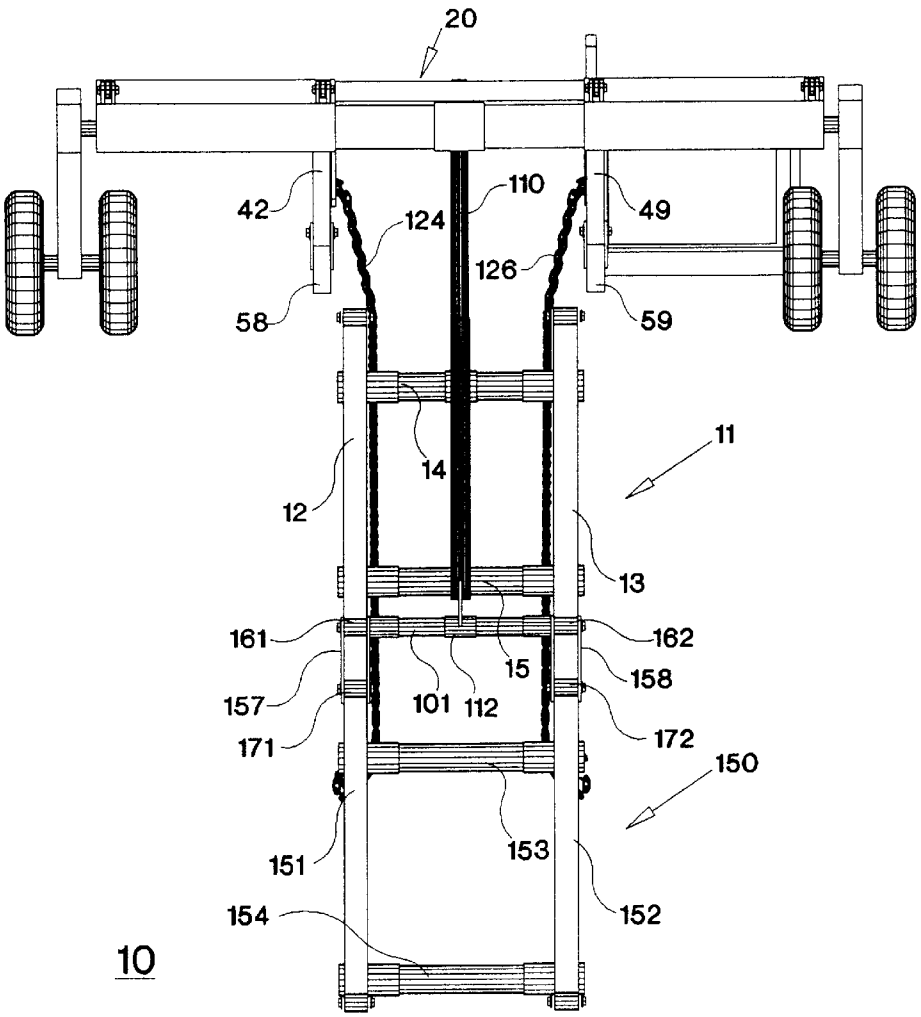
FIG. 2 is a first end representational view of the trench shoring transport device.
Figure 3:
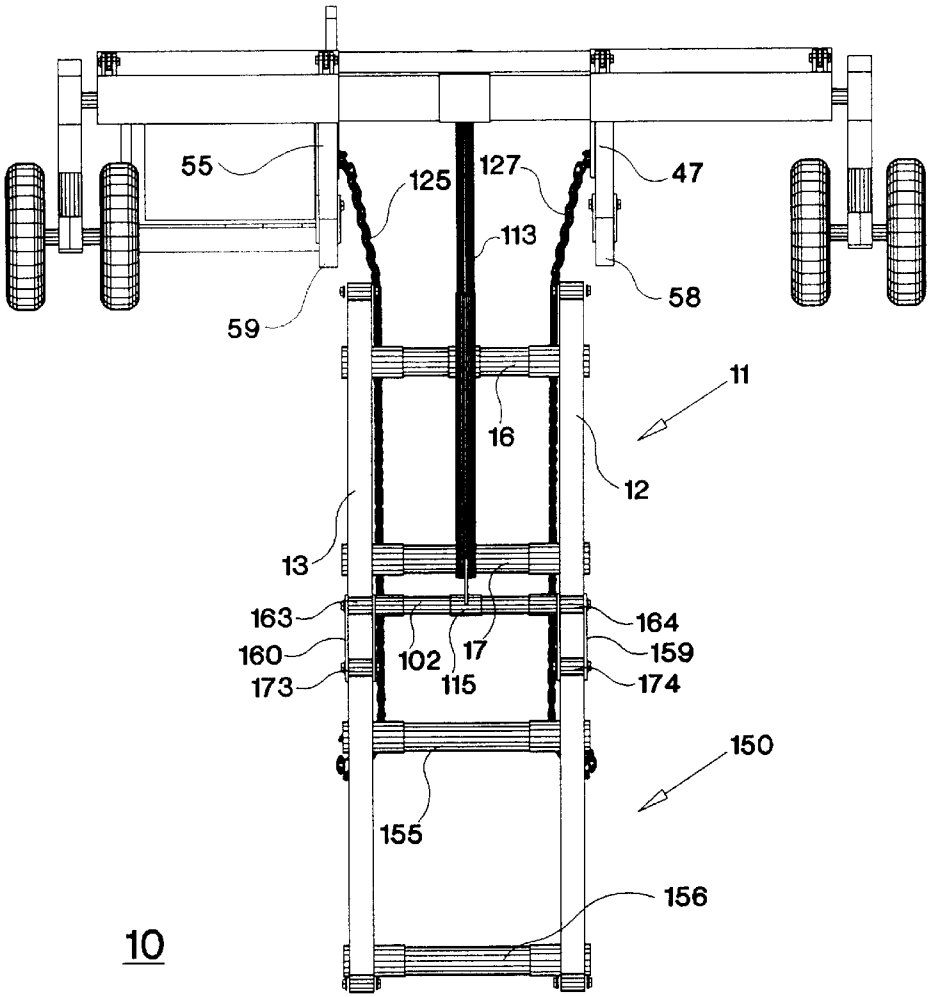
FIG. 3 is a second end representational view of the trench shoring transport device.

Referring to FIGS. 2, 3 and 9 a lower structural element extends the length of each side frame sub-assembly. The first side frame sub-assembly 21 includes first side frame spanner 58 which attaches to the lower ends of first side frame first vertical member 41 by first side frame first vertical connector 42, first side frame second vertical member 43 by first side frame second vertical connector 44, first side frame third vertical member 45 by first side frame third vertical connector 46 and first side frame fourth vertical member 4 7 by first side frame fourth vertical connector 48. Similarly, second side frame sub-assembly 22 includes second side frame spanner 59 which attaches to second side frame first vertical member 49 by second side frame first vertical connector 50, second side frame second vertical member 51 by second side frame second vertical connector 52, second side frame third vertical member 53 by second side frame third vertical connector 54, and second side frame fourth vertical member 56 by second side frame fourth vertical connector 57.

Referring again to FIG. 9 frame 20 further includes first transverse spanner 62 and second transverse spanner 70 which extend across the width of the frame 20 which, together with first frame end telescoping member 60 and second frame end telescoping member 61 hold first side frame sub-assembly 21 and second side frame sub-assembly 22 in sliding and adjustable engagement with each other.

First transverse spanner 62 includes first transverse spanner first end 63 and first transverse spanner second end 66. First transverse spanner first end 63 is pivotally attached to first side frame sub-assembly 21 by first transverse spanner hinged connector 64 and first transverse second hinged connector 65. Similarly, first transverse spanner second end 66 is pivotally attached to second side frame sub-assembly 22 by first transverse third hinged connector 67 and first transverse fourth hinged connector 68. First transverse spanner first end 63 and first transverse spanner second end 66 are slideably engaged with one another by first transverse spanner telescoping member 69.

Second transverse spanner 70 includes second transverse spanner first end 71 and second transverse spanner second end 74. Second transverse spanner first end 71 is pivotally attached to first side frame sub-assembly 21 by second transverse first hinged connector 72 and second transverse second hinged connector 73. Similarly, second transverse spanner second end 74 is pivotally attached to second side frame sub-assembly 22 by second transverse third hinged connector 75 and second transverse fourth hinged connector 76. Second transverse spanner first end 71 and second transverse spanner second end 74 are slideably and adjustably engaged by second transverse spanner telescoping member 77.

In the preferred embodiment of the invention, a means for adjusting the length of first transverse spanner 62 and second transverse spanner 70 and thereby the overall width of frame 20 is provided. One embodiment of the invention includes first adjustment screw 78 which passes through the length of first transverse spanner 62 and second adjustment screw 79 which passes through the length of second transverse spanner 70. By rotating first adjustment screw 78 and second adjustment screw 79. Each adjustment screw is effectively a leadscrew which passes through a pair of fixed carriages, one carriage located within each of the two transverse spanner end members. As the adjustment screw is rotated, the transverse spanner is lengthened or shortened, depending upon the direction of rotation.

An alternate embodiment of the invention allows the length of trench shoring transport 10 to be adjustable by fabricating first side frame side member 23, second side frame side member 24 first side frame spanner 58 and second side frame spanner 59 as telescoping members.

In the preferred embodiment of the invention, all structural components are formed of commonly available structural steel shapes, including square and rectangular steel tubing and plate. The trench shoring transport 10, however, may be manufactured of other materials having adequate structural characteristics.

Figure 8:
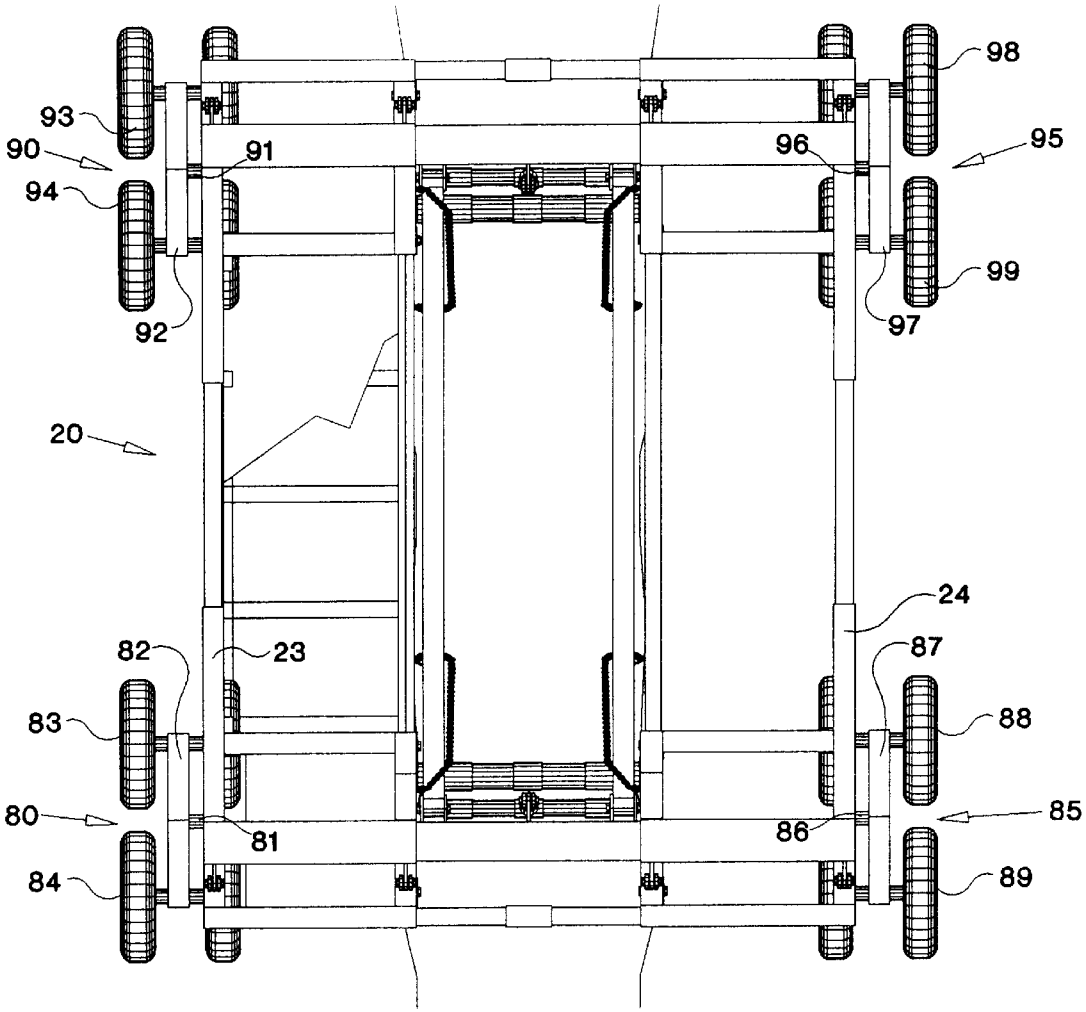
FIG. 8 is a top representational view of the trench shoring transport device.

Frame 20 is supported by a number of wheel assemblies as shown in the figures. As shown in FIG. 8, frame 20 is supported by first wheel assembly 80, second wheel assembly 85, third wheel assembly 90 and fourth wheel assembly 95. First wheel assembly 80 includes first wheel assembly axle 81 which attaches is at first side frame side member 23.

First wheel assembly arm 82 is pivotally attached to first wheel assembly axle 81 and allows first wheel assembly lead wheel assembly 83 and first wheel assembly trailing wheel assembly 84 to rotate about first wheel assembly axle 81 allowing the wheel assembly to adjust as required to variations in the topography located along beside an excavated trench.

Similarly, second wheel assembly 85 attaches at second side frame side member 24 by second wheel assembly axle 86. Second wheel assembly arm 87 is pivotally attached to second wheel assembly axle 86. Second wheel assembly lead wheel assembly 88 and second wheel assembly trailing wheel assembly 89 are attached at either end of second wheel assembly arm 87.

Third wheel assembly 90 includes first wheel assembly axle 91 which attaches to and extends horizontally from first side frame side member 23. Pivotally attached to third wheel assembly axle 91 is first wheel assembly arm 92 which pivots on first wheel assembly axle 91. Mounted to first wheel assembly arm 92 are first wheel assembly lead wheel assembly 93 and first wheel assembly trailing wheel assembly 94.

Similarly, fourth wheel assembly 95 includes fourth wheel assembly axle 96 which attaches to and extends horizontally from second side frame member 24. Fourth wheel assembly arm 97 is pivotally attached to second wheel assembly axle 96. Fourth wheel assembly lead wheel assembly 98 and second wheel assembly trailing wheel assembly 99 are attached at either ends of second wheel assembly arm 97.

In the preferred embodiment of the invention, each of the lead wheel assemblies and the trailing wheel assemblies of third wheel assembly 90 and fourth wheel assembly 95 are castors which allow 360° of free rotation which facilitates positioning of the frame in the working environment.

As shown in FIGS. 2 through 7, suspendable from frame 20 is upper trench box 11, including first trench box panel 12 and second trench box panel 13, which are held in spaced apart relationship by first spreader 14, second spreader 15, third spreader 16 and fourth spreader 17. The various spreaders may be of a fixed length or may be adjustable in length.

Figure 5:
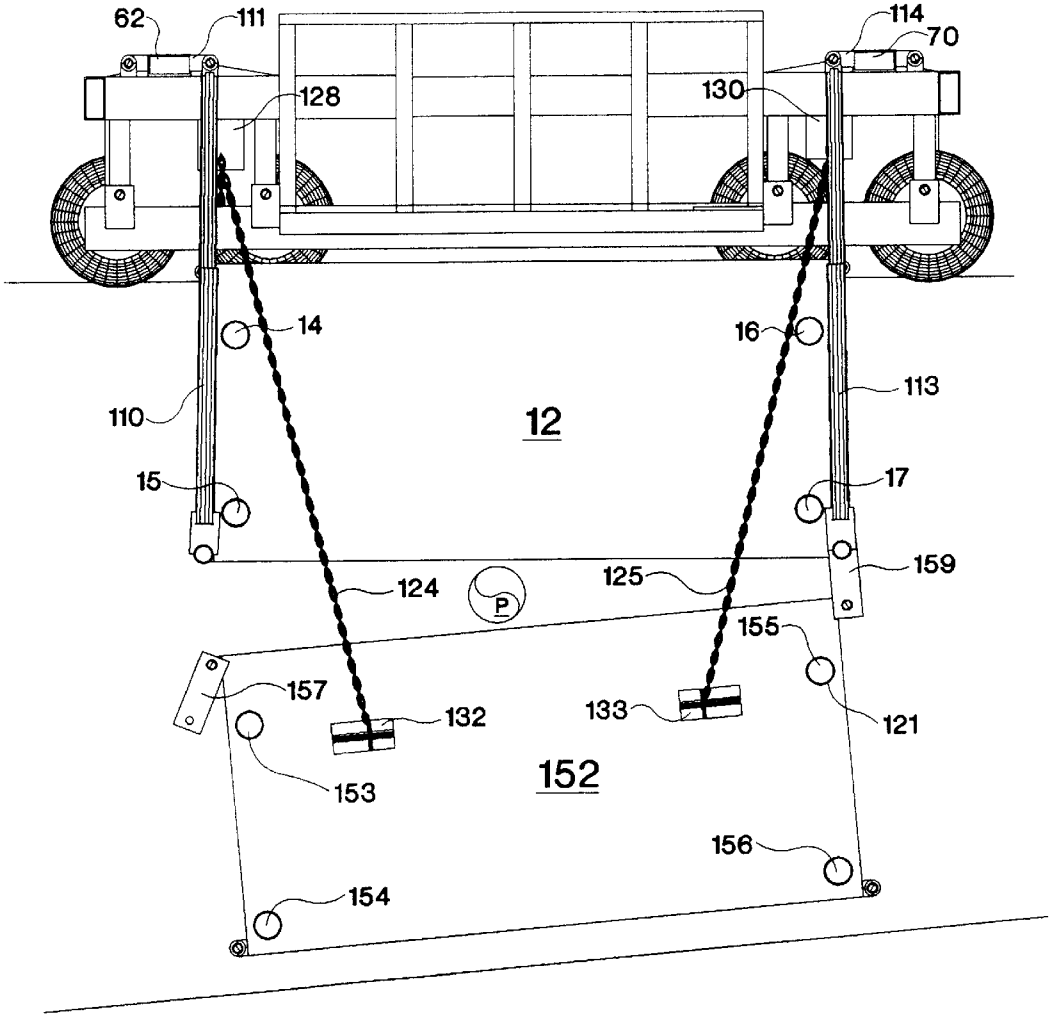
FIG. 5 is a cutaway side representational view of the trench shoring transport device.

Referring to FIGS. 2, 3 and 5, upper trench box 11 depends from frame 20 by first hydraulic arm 110 and second hydraulic arm 113. First hydraulic arm 110 is pivotally attached to first hydraulic arm first end connector 111 which extends from first transverse spanner 62. Similarly, second hydraulic arm 113 is pivotally attached to second hydraulic arm first end connector 114 which attaches to and extends from second transverse spreader 70.

Means for attaching the second end of first hydraulic arm 110 and the second end of second hydraulic arm 113 to trench box 11 are provided. In the preferred embodiment of the invention the means for attachment takes the form of a pair of auxiliary spreaders shown in FIGS. 2 and 3, as first auxiliary spreader 101 and second auxiliary spreader 102. First auxiliary spreader 101 attaches between trench box first lower ear 161 and trench box second lower ear 162. Similarly, second auxiliary spreader 102 attaches between trench box third lower ear 163 and trench box fourth lower ear 164. The second end of first hydraulic arm 110 is pivotally attached to first hydraulic arm second end connector 112 which is configured as a sleeve which is slideably mountable on first auxiliary spreader 101. Similarly, the second end of second hydraulic arm 113 is attached to second hydraulic arm second end connector 115 which is also configured as a collar which is slideably mountable on second auxiliary spreader 102.

Figure 6:
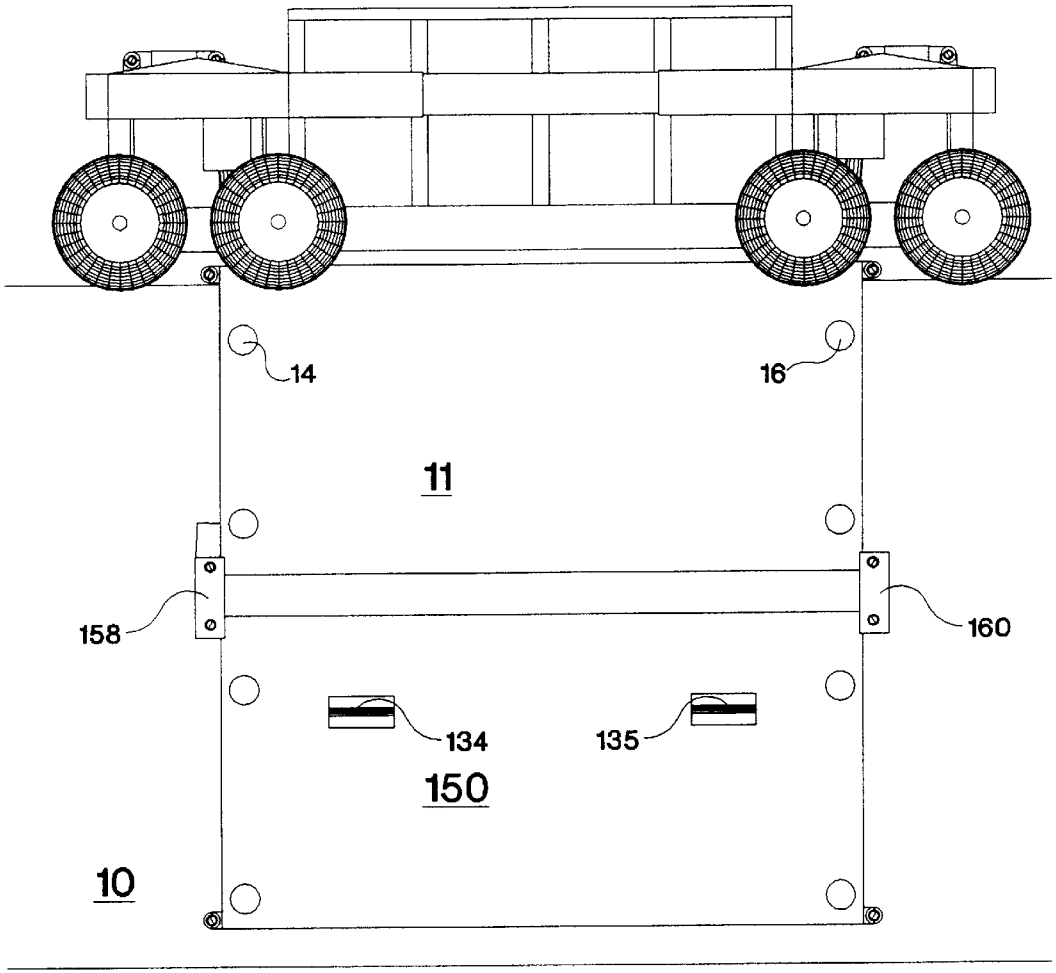
FIG. 6 is a side representational view of an alternate embodiment of the trench shoring transport device.
Figure 7:
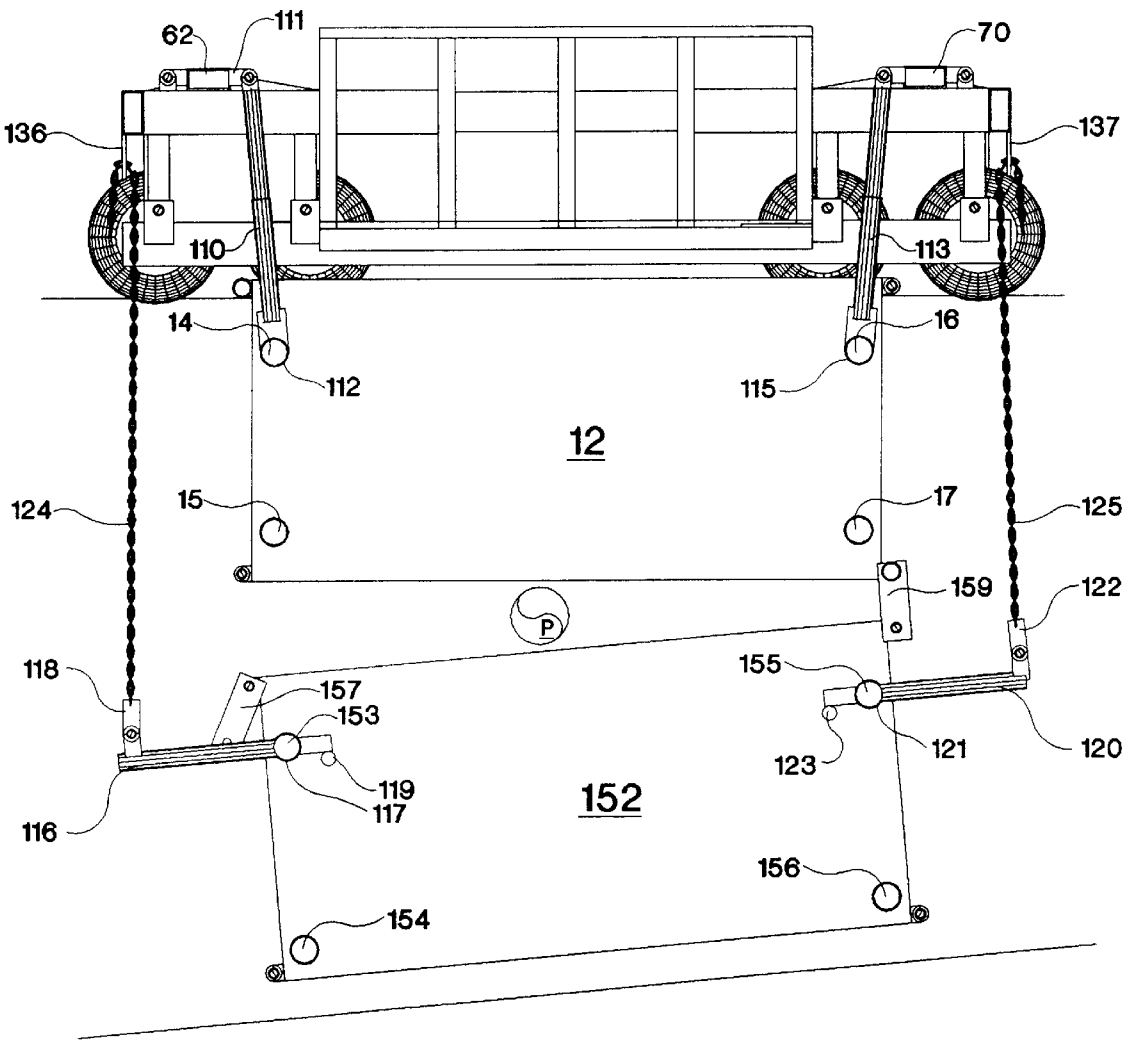
FIG. 7 is a cutaway side representational view of an alternate embodiment of the trench shoring transport device.

In an alternate embodiment of the invention, shown in FIGS. 6 and 7, the second end of first hydraulic arm 110 is pivotally attached to first hydraulic arm second end connector 112 which is configured as a sleeve which is slideably mountable on first spreader 14. Similarly, the second end of second hydraulic arm 113 is attached to second hydraulic arm second end connector 115 which is also configured as a collar which is slideably mountable on third spreader 16. It should be specifically noted that, while the figures depict second end connectors located on the upper spreaders, these second end connectors are slideably mountable on any of the trench box spreaders as required for operation of trench shoring transport 10.

Figure 10:
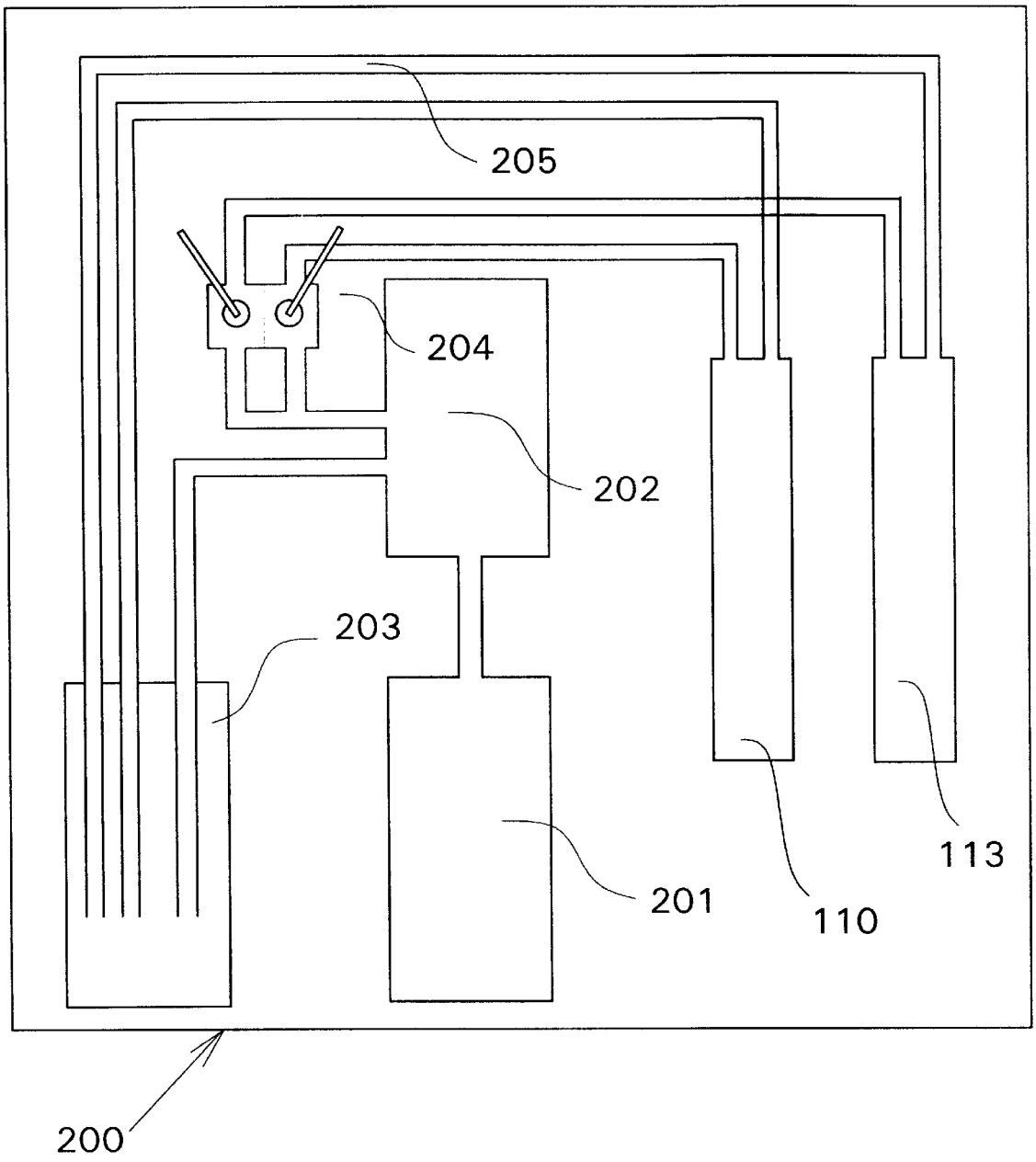
FIG. 10 is a schematic representational view of the hydraulic power unit of the trench shoring transport device.

As shown in FIG. 10, a means for adjusting the length of first hydraulic arm 110 and second hydraulic arm 113 is provided. In the preferred embodiment of the invention, this means is provided by a hydraulic power unit. As shown in FIG. 10 hydraulic power unit 200 includes power plant 201 which is typically a gasoline engine although other options are commonly available and pump 202. Pump 202 is operative connected to hydraulic reservoir 203 and to first hydraulic arm 110 and second hydraulic arm 113 through controls 204 by hoses 205. It should also be recognized that other means for raising and lowering the trench boxes are recognized although not employed in the current embodiment of the invention including electrically actuated cable hoists.

As shown in FIGS. 1 through 7, trench boxes may be connected in series employing H-clips 157, 158, 159 and 160. H-clips 157, 158, 159 and 160 attach at their upper ends to connectors 161, 162, 163 and 164 and at their lower ends to connectors 171, 172, 173 and 174. Lower trench box 150 includes third trench box panel 151 and fourth trench box panel 152. These panels are held in spaced apart relationship by fifth spreader 153, sixth spreader 154, seventh spreader 155 and eighth spreader 156.

Another feature of one embodiment of the present invention allows upper trench box 11 to be split or separated from lower trench box 150 during operations. This feature is useful where a pipeline or other obstruction is encountered during excavations which runs substantially transverse to the to the excavation.

In the preferred embodiment of the invention, a secondary means for suspending a trench box from the frame is provided in the form of a number of chains attachable to and dependable from the frame. The second end of each chain may be secured to the trench box to permit greater versatility in lifting and positioning trench boxes and provides a means for splitting the upper trench box from the lower trench box during operations. As shown in FIGS. 2 through 7, the secondary means for suspending a trench box from the frame includes first chain 124, second chain 125, third chain 126 and fourth chain 127.

Figure 4:
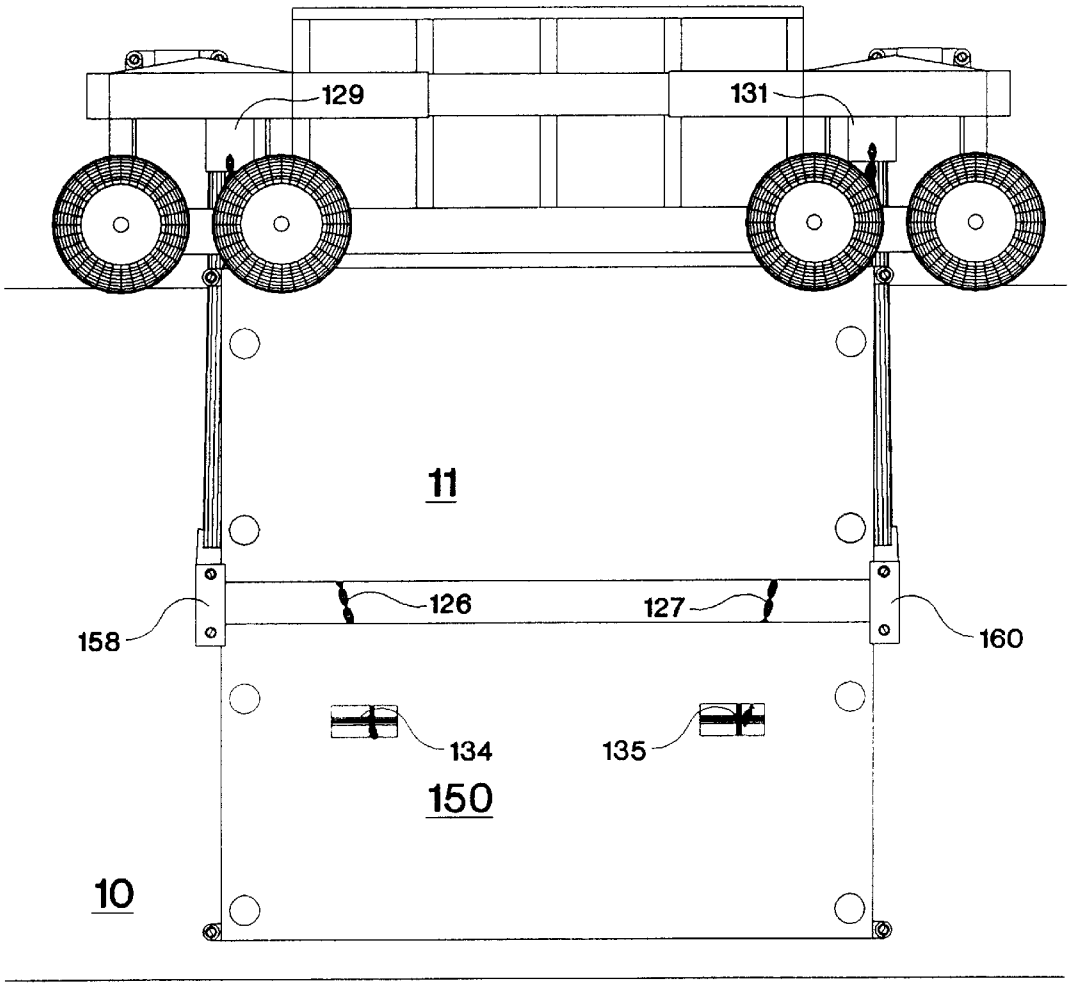
FIG. 4 is a side representational view of the trench shoring transport device.

In the preferred embodiment shown in FIGS. 4, 5 and 9, the first end of first chain 124 is secured within first frame chain eye 128 which is secured to frame 20. Similarly, the first end of second chain 125 is secured within second frame chain eye 130. The first end of third chain 126 is secured within third frame end chain eye 129 and the first end of fourth chain 127 is secured within fourth frame end chain eye 131. The second end of first chain 124 is attachable to trench box first attachment point 132. The second end of second chain 125 is attachable to trench box second attachment point 133. Similarly, the second end of third chain 126 is attachable to trench box third attachment point 134 and the second end of fourth chain 127 is attachable to trench box fourth attachment point 135.

In an alternate embodiment of the invention shown in FIGS. 6 and 7, the means for splitting the upper trench box from the lower trench box during operation includes first auxiliary bar 116 and second auxiliary bar 120. First auxiliary bar 116 includes first auxiliary bar collar 117 which is slideably mountable to a trench box spreader. Specifically, first auxiliary bar 116 is mounted to fifth spreader 153. Located at the second end of first auxiliary bar 116 is first auxiliary bar connector 118. In operation, first auxiliary bar is configured to rotate on the spreader from a vertical hanging position to a horizontal position where rotation of the auxiliary bar is limited by first auxiliary bar stop 119 thereby holding first auxiliary bar 116 is a horizontal position.

Similarly, second auxiliary bar 120 includes second auxiliary bar collar 121 which is slideably mountable, in this case, to seventh spreader 155. Second auxiliary bar 120 also includes second auxiliary bar connector 122 and second auxiliary bar stop 123.

As shown in FIG. 7, first chain 124 depends from first frame chain eye 136. Similarly, second chain 125 depends from second frame chain connector 137. When transverse pipe P is encountered in excavation, upper trench box 11 may be split by engaging the second end of first chain 124 in first auxiliary bar eye 118. H-clips 157 may then be removed, splitting the upper and lower halves of upper trench box 11 allowing transverse pipe P to pass through the box panels. This operation is repeated at both ends of the box as the excavation proceeds allowing pipe P to pass through trench shoring transport 10.

Trench shoring transport 10 may also include, in various embodiments, a pipe laydown rack or a work platform 140, as shown in FIG. 1.

In use, trench shoring transport 10 is first positioned over a ditch. This is accomplished with a truck, tractor or other powered implement located at the excavation site (not shown). Once frame 20 is positioned directly over the open trench or excavation, first trench box 11 is lowered between first side frame spanner 58 and second side frame spanner 59, once again by a power shovel, hoe or other powered implement located at the excavation site (not shown). In the event that the distance between first side frame spanner 58 and second side frame spanner 59 needs to be adjusted, first side frame sub-assembly 21 and second side frame sub-assembly 22 may be moved nearer to one another or farther away effectively adjusting the distance between the side frame spanners and hence the wheel base of power trench shoring transport 10.

Trench box 11 depends from frame 20 by first hydraulic arm 110 and second hydraulic arm 113. First hydraulic arm 110 attaches to frame 20 at its first end and at its second end to trench box 11 by first hydraulic arm second end connector 112. Similarly, second hydraulic arm 113 attaches to frame 20 at its first end and at its second end to trench box 11 by second hydraulic arm second end connector 115.

Trench box 11 may then be raised and lowered by activating controls 204 for hydraulic power unit 200.

Trench box sections may be added and/or subtracted from the overall configuration by raising and/or lowering trench boxes as required through frame 20. In order to remove a trench box, first chain 124, second chain 125, third chain 126 and fourth chain 127, are connected to the shown in FIGS. 4 and 5, the first end of first chain 124 is secured within first frame chain eye 128, the first end of second chain 125 is secured within second frame chain eye 130, first end of third chain 126 is secured within third frame end chain eye 129 and the first end of fourth chain 127 is secured within fourth frame end chain eye 131. The second end of first chain 124 is attached to trench box first attachment point 132. The second end of second chain 125 is attachable to trench box second attachment point 133. Similarly, the second end of third chain 126 is attachable to trench box third attachment point 134 and the second end of fourth chain 127 is attachable to trench box fourth attachment point 135.

Next, first hydraulic arm 110 is disconnected from trench box 11 by removing first auxiliary spreader 101 and second auxiliary spreader 102 from between trench box first lower ear 161 and trench box second lower ear 162. Similarly, second hydraulic arm 113 is disconnected from trench box 11 by removing second auxiliary spreader 102 from between trench box third lower ear 163 and trench box fourth lower ear 164. At this point, trench box 11 may be lifted away by a power shovel, hoe or other powered implement located at the excavation site (not shown).

Next, first hydraulic arm 110 and second hydraulic arm 113 are connected to trench box 150 by attaching first auxiliary spreader 101 and second auxiliary spreader 102 between the lower ears located at either end of trench box 150. First chain 124, second chain 125, third chain 126 and fourth chain 127 may now be removed as the weight of trench box 150 is now carried by first hydraulic arm 110 and second hydraulic arm 113.

As trench shoring transport device 10 approaches an obstacle such as a pipeline laying transverse to the excavation, as shown in FIG. 5, trench box 11 and trench box 150 may be split from one another allowing the obstacle to pass between the trench boxes. First hydraulic arm 110 is lowered to a position where the top edge of trench box 150 is below the obstruction which will allow passage of the obstacle when the first trench box 11 is separated from second trench box 150. Next, first chain 124, second chain 125, third chain 126 and fourth chain 127, are connected to the shown in FIGS. 4 and 5, the first end of first chain 124 is secured within first frame chain eye 128, the first end of second chain 125 is secured within second frame chain eye 130, first end of third chain 126 is secured within third frame end chain eye 129 and the first end of fourth chain 127 is secured within fourth frame end chain eye 131. The second end of first chain 124 is attached to trench box first attachment point 132. The second end of second chain 125 is attachable to trench box second attachment point 133. Similarly, the second end of third chain 126 is attachable to trench box third attachment point 134 and the second end of fourth chain 127 is attachable to trench box fourth attachment point 135.

At this point, H-clips 157 and 158 are removed and first trench box 11 raised by operation of first hydraulic arm 110 to split the boxes as shown in FIG. 5. As trench shoring transport device 10 advances, pipeline P will abut first chain 124 and third chain 126. At this point, H-clip 159 and H-clip 160 (shown in FIG. 4) are disconnected and upper trench box 11 and lower trench box 150 are supported entirely by first chain 124, second chain 125, third chain 126, and fourth chain 127. First trench box 11 may be raised or lowered as required by operation of first hydraulic arm 110 so that H-clip 157 and H-clip 158 (shown in FIG. 4) may be reconnected. At this point, the second end of first chain 124 and the second end of third chain 126 are released from first attachment point 132 and trench box third attachment point 134, respectively.

Trench shoring transport device 10 continues to advance and pipeline P continues to pass between first trench box 11 and second trench box 150.

As trench shoring transport device 10 advances, pipeline P will abut second chain 125 and fourth chain 127. At this point, the second end of first chain 124 and the second end of third chain 126 are reattached at trench box first attachment point 132 and trench box third attachment point 134, respectively. Next, first hydraulic arm 110 and hydraulic arm 113 may be raised or lowered as required until H-clip 159 and H-clip 160 (shown in FIG. 4) may be reconnected. Second chain 125 and fourth chain 127 are disconnected and trench shoring transport device 10 advances nearer H-clip 159 and H-clip 160.

At this point, the second end of second chain 125 is reattached to trench box second attachment point 133 and the second end of fourth chain 127 is reattached to trench box fourth attachment point 135. H-clip 159 and H-clip 160 may now be released and trench box 150 is once again supported entirely by first chain 124, second chain 125, third chain 126, and fourth chain 127.

Trench shoring transport device 10 may now advance again as pipeline P clears the length of the device. First hydraulic arm 110 and second hydraulic arm 113 may now be raised until H-clip 157, H-clip 158, H-clip 159, and H-clip 160 may be reconnected.

In the alternate embodiment of the invention shown in FIGS. 6 and 7, as trench shoring transport device 10 approaches an obstacle such as a pipeline laying substantially transverse to the excavation, as shown in FIG. 7, first hydraulic arm 110 is lowered to a position where the top edge of trench box 150 is below the obstruction which will allow passage of the obstacle when the first trench box 11 is separated from second trench box 150. Next, auxiliary bar 116 is rotated to a horizontal position where its motion is restricted by first auxiliary bar stop 119. The upper end of first chain 124 is inserted in first frame end chain eye 125. In this position, the second end of first chain 124 hangs directly over the end of first auxiliary bar 116. The second end of first chain 124 is inserted through first frame auxiliary bar eye 118. H-clips 157 and 158 may now be removed and first trench box 11 raised by operation of first hydraulic arm 110 to split the boxes as shown in FIG. 5. The opposite end of the trench boxes may be split by following a similar procedure involving the components located at the opposite end of the device. Once the obstacle has passed the trench boxes, the trench boxes may be reattached and the auxiliary arms disconnected and swung out of the way.

While there is shown and described the preferred embodiment of the invention. It is to be distinctly understood that this invention is not limited thereto but may be variously embodied to practice within the scope of the following claims.

I claim:

1. A trench shoring transport device comprising:

a frame including a first side frame subassembly and a second side frame subassembly slideably connected to the first side frame subassembly;

a wheel assembly attached to the frame and supporting the frame;

a primary means for suspending a first trench box from the frame attached to and depending from the frame and having means for engaging the frame, the primary means for suspending a first trench box from the frame including a hydraulic ram;

a first trench box attached to and depending from the primary means for suspending a first trench box from the frame.

2. The device of claim 1, wherein the frame is further configured to permit the first trench box to be raised above the frame between the first side frame subassembly and the second side frame subassembly.

3. The device of claim 1 further comprising a second trench box attached to and depending from the first trench box.

4. The device of claim 3 further comprising a means for splitting the first trench box from the second trench box for permitting passage of an obstruction between the first trench box and the second trench box.

5. The device of claim 4 wherein the means for splitting the first trench box from the second trench box further comprises a secondary means for suspending the second trench box from the frame.

6. The device of claim 5 wherein the secondary means for suspending the second trench box from the frame further comprises a chain having a first end and a second end, the first end attachable to and dependable from the frame and the second end attachable to the second trench box.

7. A trench shoring transport device comprising:

a frame having a first side frame subassembly and a second side frame subassembly slideably connected to the first side frame subassembly, wherein the frame is further configured to permit the first trench box to be raised above the frame between the first side frame subassembly and the second side frame subassembly;

a plurality of wheel assemblies attached to the frame and supporting the frame;

a primary means for suspending a first trench box from the frame and configured to raise and lower the first trench box, the primary means for suspending a first trench box from the frame including a first hydraulic ram, having a first end and a second end, the first end of said hydraulic ram attached to and depending from the frame;

a second hydraulic ram configured to raise and lower the first trench box having a first end and a second end, the first end of said second hydraulic ram attached to and depending from the frame; and a first trench box having a first panel and a second panel held in substantially parallel planar relationship by a plurality of spreaders, the first trench box attached to and depending from the first hydraulic ram and the second hydraulic ram.

8. The device of claim 7 further comprising a second trench box attached to and depending from the first trench box.

9. The device of claim 8 further comprising a means for splitting the first trench box from the second trench box for permitting passage of an obstruction between the first trench box and the second trench box.

10. The device of claim 9 wherein the means for splitting the first trench box from the second trench box further comprises a secondary means for suspending the second trench box from the frame.

11. The device of claim 10 wherein the means for suspending the second trench box from the frame further comprises a chain having a first end and a second end, the first end attachable to and dependable from the frame and the second end attachable to the second trench box.

12. A method for splitting a first trench box from a second trench box of a trench shoring transport device including a frame, a primary means for suspending the first trench box including a hydraulic ram configured to raise and lower the first trench box, the primary means for suspending the first trench box from the frame attached to and depending from the frame, the first trench box attached to and depending from the primary means for suspending the first trench box, the second trench box attached to and depending from the first trench box and a secondary means for suspending the second trench box from the frame for permitting passage of an obstruction between the first trench box and the second trench box during excavation comprising:

attaching the secondary means for suspending the second trench box from the frame to the frame and the second trench box;

disconnecting the first trench box from the second trench box; and raising the primary means for suspending the first trench box thereby separating the first trench box from the second trench box.

* * * * *